United States Patent [19]

Satake

[11] 3,952,645

[45] Apr. 27, 1976

[54] GRAIN HULLING AND SORTING APPARATUS

[76] Inventor: Toshihiko Satake, Saijo-cho, 2-38, Nishihon, Kamo, Hiroshima, Japan

[22] Filed: Dec. 2, 1974

[21] Appl. No.: 528,687

[52] U.S. Cl. ..... 99/524; 99/525; 99/529; 99/601; 99/610; 99/621

[51] Int. Cl.[2] ..... B02B 3/04

[58] Field of Search ..... 99/488, 518, 519, 520, 99/521, 524, 525, 526, 529, 530, 600, 601, 609, 611, 617, 621, 622; 241/80

[56] References Cited

UNITED STATES PATENTS

| | | | |
|---|---|---|---|
| 144,180 | 11/1873 | Andrews et al. | 99/520 X |
| 1,212,113 | 1/1917 | Schäfler | 99/518 |
| 2,011,110 | 8/1935 | Lorenzen | 99/519 X |
| 2,468,321 | 4/1949 | Bland | 241/80 X |
| 3,334,675 | 8/1967 | Satake | 99/600 |
| 3,835,766 | 9/1974 | Satake | 99/525 |

FOREIGN PATENTS OR APPLICATIONS

| | | | |
|---|---|---|---|
| 898,209 | 6/1962 | United Kingdom | 209/466 |

*Primary Examiner*—Robert W. Jenkins
*Assistant Examiner*—James A. Niegowski
*Attorney, Agent, or Firm*—Browdy and Neimark

[57] ABSTRACT

Apparatus comprising hulling means, winnowing means, sorting means, and conveyor means. Said hulling and winnowing means are housed in a platform-like box having longer longitudinal sides and shorter transverse sides. The sorting means is operated to move along the longitudinal sides of box, and the path of circulation of grain through the hulling means, conveyor means and sorting means is made short by locating them adjacently to each other.

5 Claims, 10 Drawing Figures

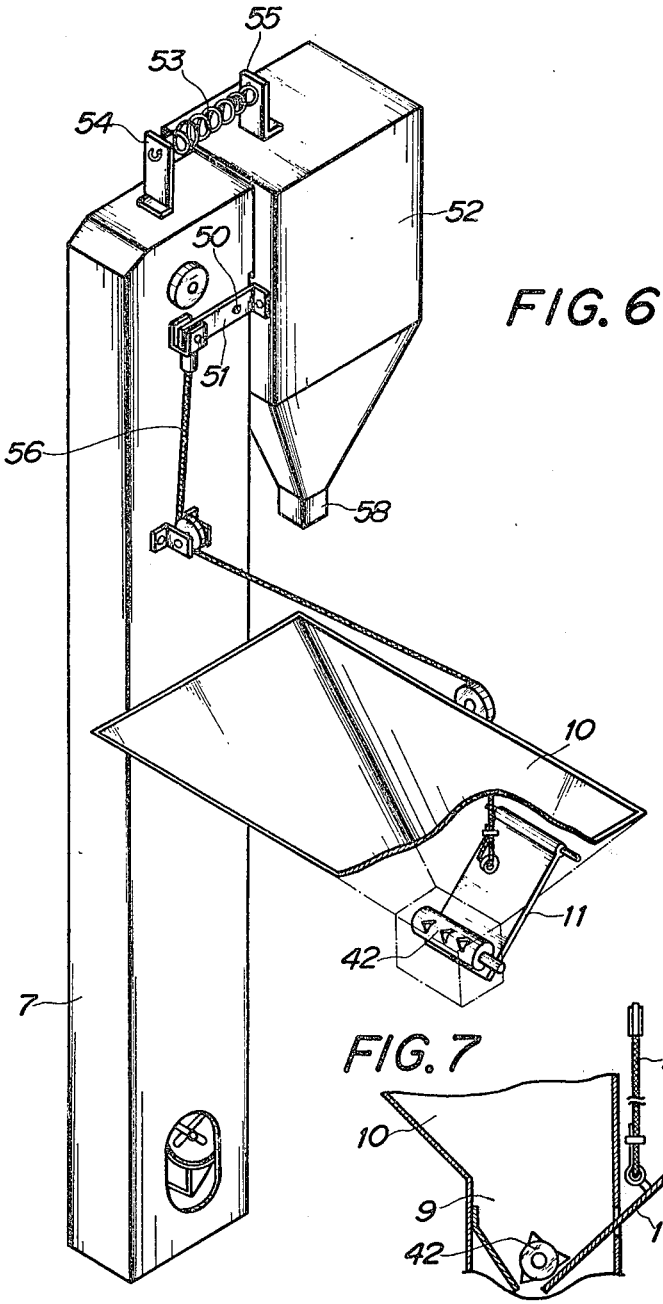
FIG. 6
FIG. 7
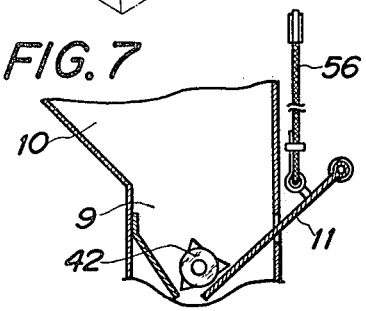

GRAIN HULLING AND SORTING APPARATUS

The present invention relates to a grain hulling and sorting apparatus.

In the grain such as rice which is taken out from a hulling device, there are mixed completely hulled rice, incompletely hulled or unhulled rice, and hulls produced with the hulling operation. The hulls may readily be separated from the rice by means of winnowing, but the hulled rice and unhulled rice are separated each other with difficulties by various separating means such as, for example, a sorting device provided with a obliquely reciprocating pan and disclosed for example in U.S. Patent application Ser. No. 348,306, now U.S. Pat. No. 3,857,333 issued Dec. 31, 1974 of the present inventor.

In conventional apparatuses of the kind described above and equipped with hulling means and sorting means, the latter means is far larger than the former in their sizes. Hence, a sorting means especially of the type in which a sorting pan is obliquely reciprocated is placed to one side of a hulling means which is fixed on a suitable supporting frame, and these two means are operatively connected to each other by a grain tranfer means. This means that a floor space has to be large enough to accommodate therein the two means which are placed aside each other, and that a comparatively expensive and complicated grain transfer means has to be employed, which results in making the whole equipment rather complicated and expensive. In order to minimize the above disadvantages, the present inventor has proposed a grain sorting apparatus such as the one disclosed in the aforementioned U.S. Patent application Ser. No. 348,306, which requires a comparatively small floor space for the installation and does not require an independent grain transfer means. However, the inventor has found out that there is still a room for improvement in his proposed former grain sorting apparatus, especially at the points of the separation of hulls and the way of incorporation of his obliquely reciprocating sorting pan into the hulling means.

More concretely, in the present invention, a horizontally extending passage is provided below a hulling means so that hulls may be separated by winnowing from the grain immediately after they are subjected to hulling operation and before they are subjected to sorting operation, whereby the efficiency of a sorting means for separating unhulled grain from hulled grain shall not be adversely affected. It is also characteristic to this invention that a frame supporting the hulling means is made substantially as a rectangle at its plan view, and a sorting pan having shorter sides considerably larger than the shorter sides of said supporting frame is placed above the frame so that it is reciprocable obliquely in the longitudinal directions of itself and the supporting frame.

It is an object of this invention, therefore, to provide a grain sorting apparatus in which a means for sorting hulled and unhulled grains which are supplied from a hulling means is integrally incorporated to and above the hulling means so that the apparatus shall be compact as a whole, and in which the hulls produced by the hulling means are separated from the grain by a winnowing means provided below the hulling means so that the hulls shall not be supplied to the sorting means, whereby its sorting efficiency is remarkably improved.

It is another object of the present invention to provide a grain sorting apparatus of the kind mentioned above, in which the sorting means consists of a separating pan which is reciprocable obliquely to a frame housing the hulling and winnowing means, and in which the dimensional relation between the sorting means and the frame is characteristically decided.

In the accompanying drawing in which a preferred embodiment of the present invention is illustrated:

FIG. 6 is a perspective view of the means illustrated in FIG. 5;

FIG. 7 is an enlarged sectional view of a part of the means illustrated in FIGS. 5 and 6;

Figure 1:
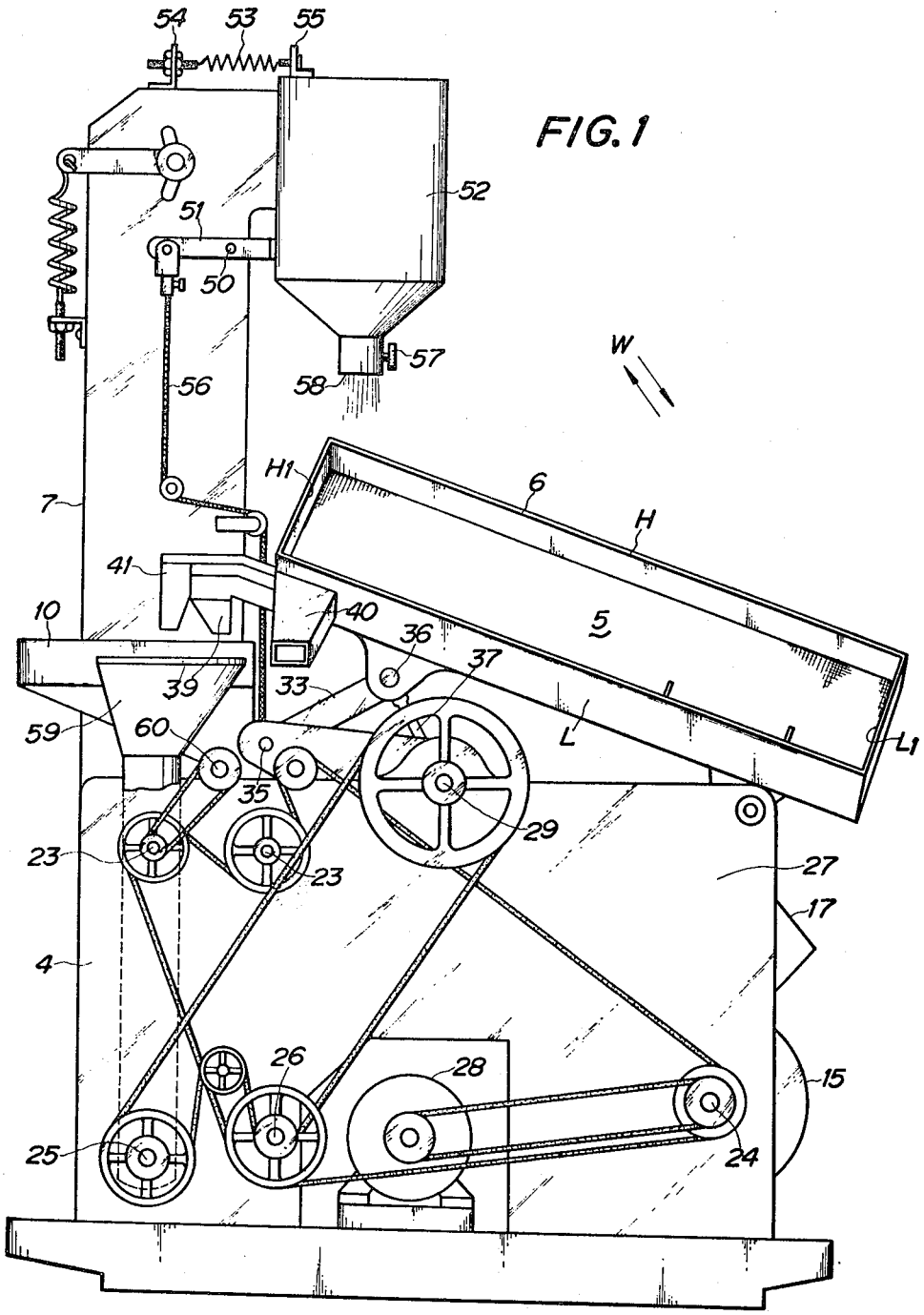
FIG. 1 is a side view showing the overall outer appearance of the present grain sorting apparatus.
Figure 3:
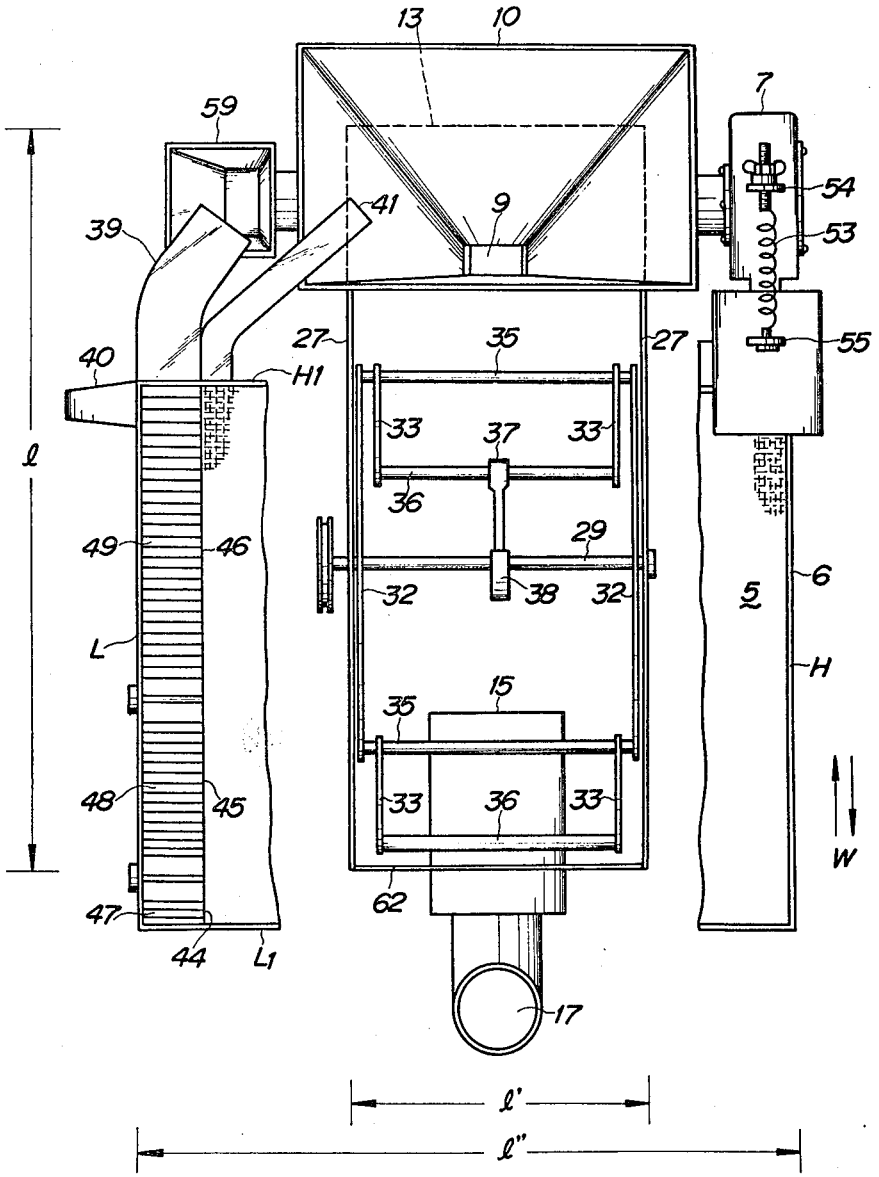
FIG. 3 is a plan view of the overall apparatus, parts of which are cut open.

Now, with reference to the drawing, a supporting frame box 4 consists of a front wall 13, rear wall 62, and right-hand and left-hand walls 27, 27, and as best shown in FIG. 3, the right- and left-hand walls are longer than other sides 13, 62. At an upper part within the box 4 and near to the front wall 13 there is provided a hulling chamber 1, while at a location opposite to said hulling chamber there is provided a suction chamber 3. A pair of hulling rolls 8, 8 are rotatably mounted on shafts 23, 23 which extend transversely within the hulling chamber 1. A supply opening 9 is provided at the upper wall 63 of hulling chamber 1, and above said opening, fitted is a grain or rice supply hopper 10. At said supply opening 9, there are pivoted a supply roll 42 for unhulled rice and a valve 11 for controlling the supply amount of grain to the hulling chamber. Said valve 11 is automatically controlled being operatively connected to a hopper 52 of basket conveyor 7 by means of a wire cable 56, as more fully explained hereinafter. An opening 12 is provided at the bottom part of hulling chamber 1 for discharging the grain subjected to the hulling operation, said opening 12 being connected to a longitudinally extending wind passage 2 which in turn opens at an inlet opening 14 provided to the front wall 13 at the side of the hulling chamber 1 and which is connected at the other end to the inlet opening 16 of blower 15 located in the suction chamber 3. An outlet 17 of the blower 15 opens exteriorly to the frame box 4. A trough 18 provided in the wind passage 2 adjacently to the inlet opening 14 and below the hulling chamber and having guide plates diverging longitudinally to the wind passage collects unhulled as well as hulled rice having a larger specific gravity than hulls. A screw conveyor 19 is rotatably mounted in said trough. Next to said trough and remotely from the inlet opening 14 and in parallel with said trough, there is provided another trough 20 which collects such bad rice that has a comparatively lighter specific gravity and does not fall onto the trough 18. A screw conveyor 21 is also rotatably mounted in this trough 20. Numeral 22 indicates an inlet for a secondary wind passage opened between the collecting troughs 18 and 20. It shall be noted that the shafts 23, 23 of hulling rolls 8, 8, shaft 24 of blower 15, shafts 25, 26 of screw conveyors 19, 21, and shaft 60 of supply roll 42 are all in parallel with each other and extend transversely to the longitudinal direction of the support frame. To the aforementioned shafts, there are fitted corresponding pulleys at their free ends which project outwardly from the wall 27, as shown in FIG. 1.

Figure 2:
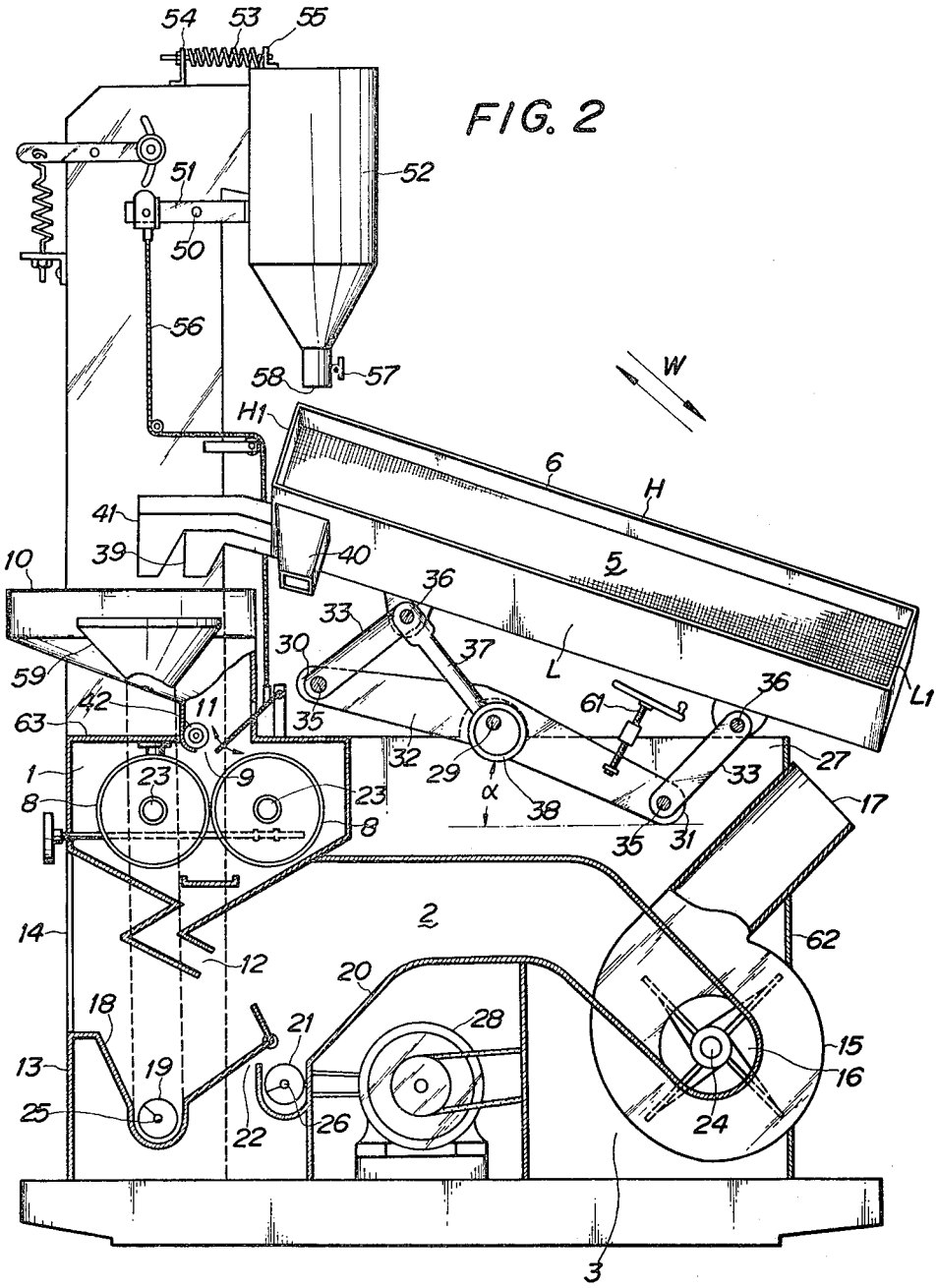
FIG. 2 is a view similar to FIG. 1 but partly cut open, showing means housed in a supporting frame box.

All the movable parts of the present sorting apparatus including the above-mentioned pulleys are driven by an electric motor 28 which is placed at the middle bottom part of the frame box 4 in the embodiment illustrated in the drawing, but which may be located exteriorly of the box, if desired. Above and intermediately to the supporting frame box 4, there is provided a rotary shaft 29 which drivingly supports a separating or sorting pan 6 and extends in parallel with the aforementioned group of shafts. Movable support shanks 32, 32 free ends 30, 31, of which are selectively adjustable up and down about the rotary shaft 29, are fitted to the said shaft 29 adjacently to its free ends. By adjusting through manually rotating a screw 61 which is fitted to each of said support shanks 32, the angle $\alpha$ by which the shanks incline against the horizon can fixedly be adjusted as desired. As best shown in FIGS. 2 and 3, the separating or sorting pan 5 is movably mounted to the support shanks 32, 32 by connecting links 33, 33 which are pivotally fitted at their low ends to the shanks 32 by pivots 35, 35, and at their upper ends to the back surface of the pan 6 by pivots 36, 36. Said links are swung about the pivots 35 with the movement of a rod 37 of eccentric 38 which operates with the rotation of the rotary shaft 29, whereby the sorting pan 6 reciprocally and obliquely swings in the direction indicated by arrows W in FIGS. 2 and 3.

Figure 4:
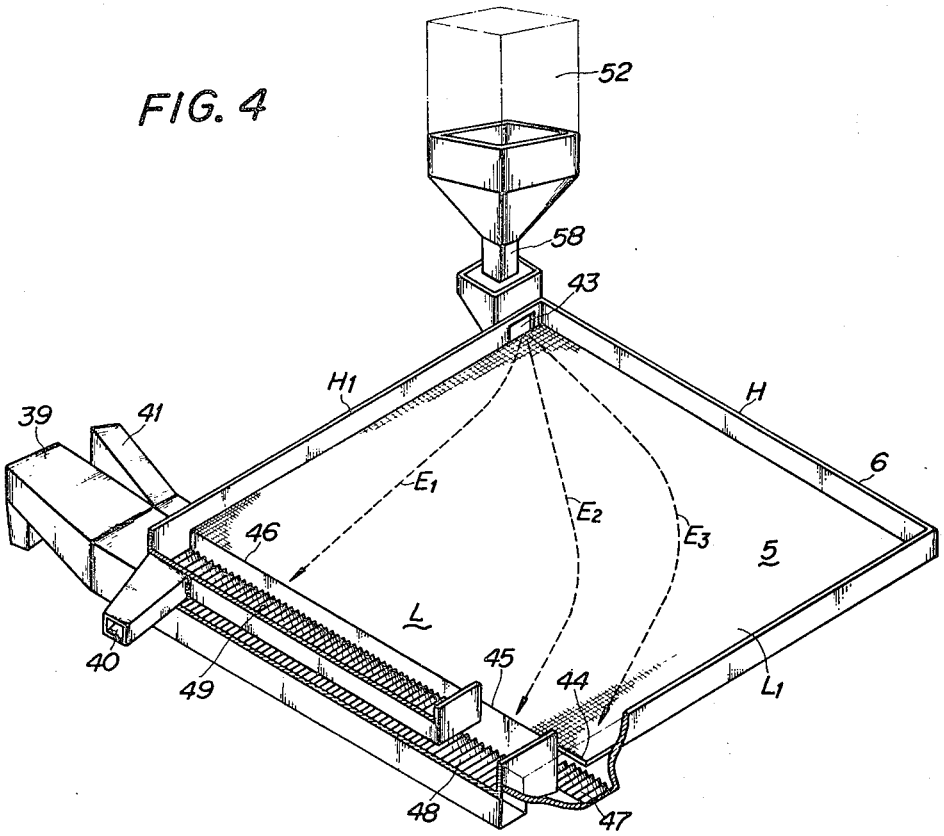
FIG. 4 is a perspective view of a grain sorting or separating pan.

Said pan 6 has a rough surface 5 which makes a fluidized friction bed with the grain supplied thereupon, and swingingly reciprocates above the frame box 4 and at a distance between the hulling chamber 1 and suction chamber 3. The movement of separating pan 6 which obliquely moves up and down in the direction of W in FIG. 2, is along its longitudinal direction when viewed in its plan as shown in FIG. 3. In other words, the pan moves obliquely up and down, when viewed from the wall 27, in such a way that it is lowered above the suction chamber 3 and elevated above the hulling chamber 1. Further, in other words, the pan is swung down at the side L1 adjacent to the suction chamber 3, and swung up at the side H1 adjacent to the hulling chamber 1. In FIG. 2, the letter H indicates a supply side, while the letter L a discharge side, said supply side being located higher than the discharge side. With reference to FIG. 4 which shows the separating pan 6 in a perspective view, a grain supplying inlet 43 is provided to the supply side H at its higher portion, and at the discharge side L there are provided adjacently to the swing-down side L1 an outlet 44 for bad rice, adjacently to swing-up side H1 an outlet 46 for hulled rice, and between these two outlets an outlet 45 for the mixture of hulled and unhulled rice. So that the grain which falls down through the outlets may automatically be conveyed laterally and upwardly to the direction of the swing-up side H1, oscillating conveyors 47, 48, 49 which respectively connect to the aforementioned outlets 44, 45, 46 are integrally fitted to the sorting pan 5.

Figure 5:
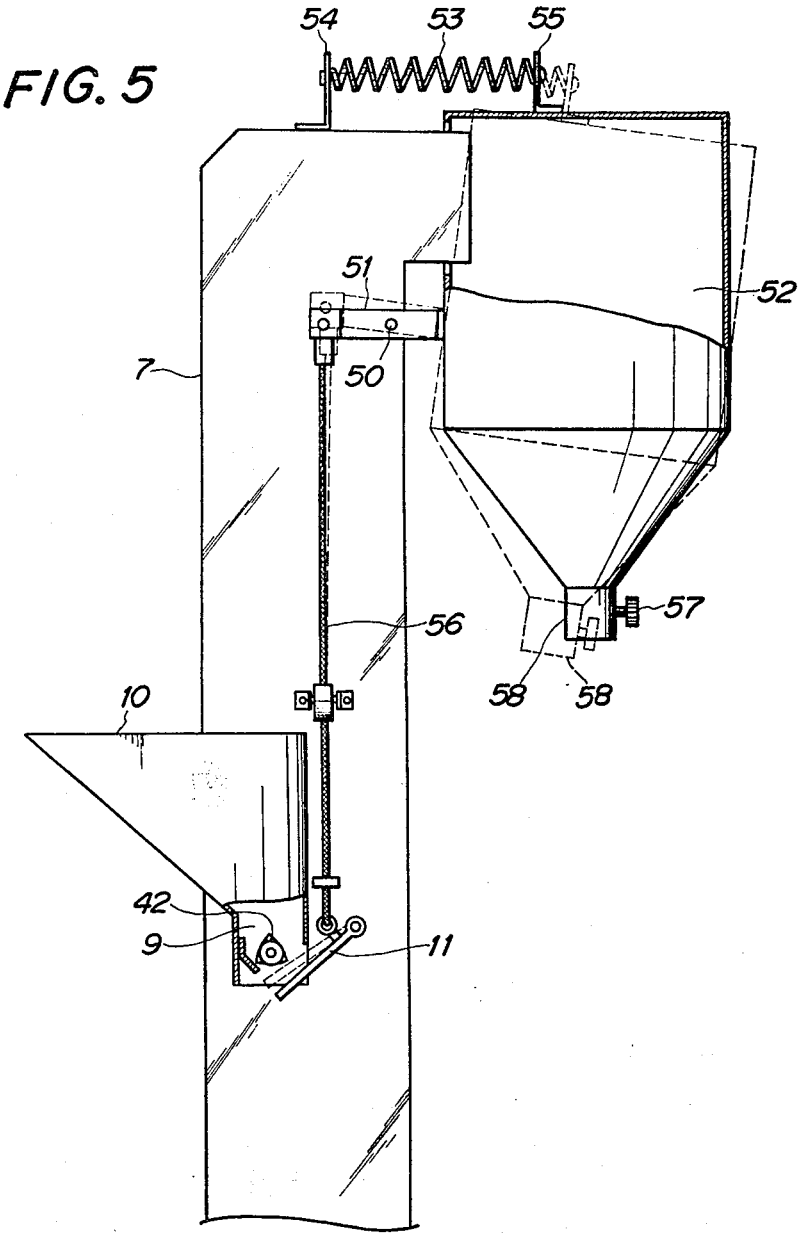
FIG. 5 is a side view of grain supply means and automatic contral devices thereto.
Figure 8:
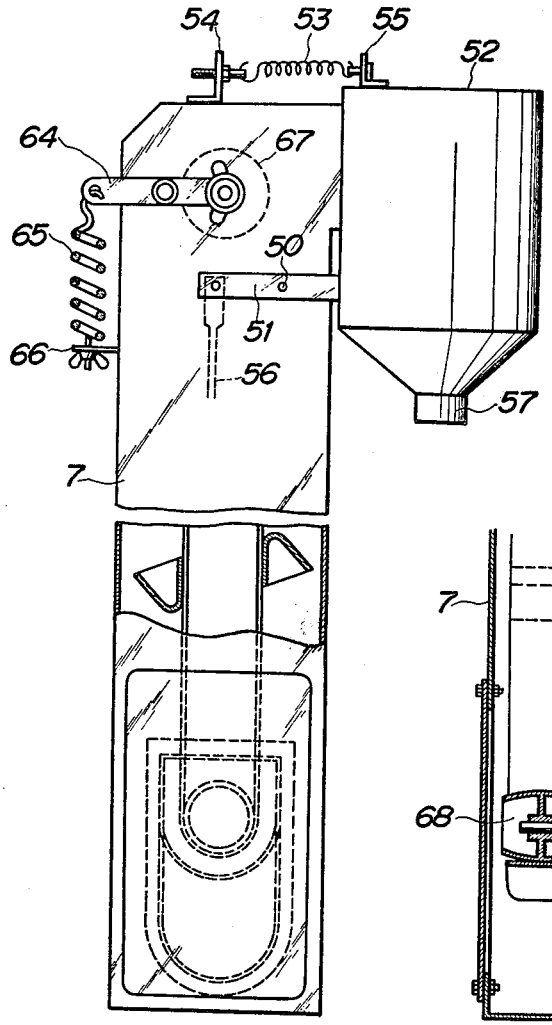
FIG. 8 is a side view of a basket conveyor associated with the grain supply means.
Figure 9:
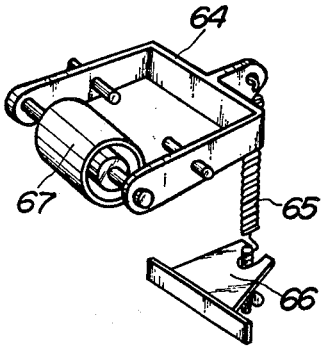
FIG. 9 is a perspective view of a pulley employed in in the basket conveyor.
Figure 10:
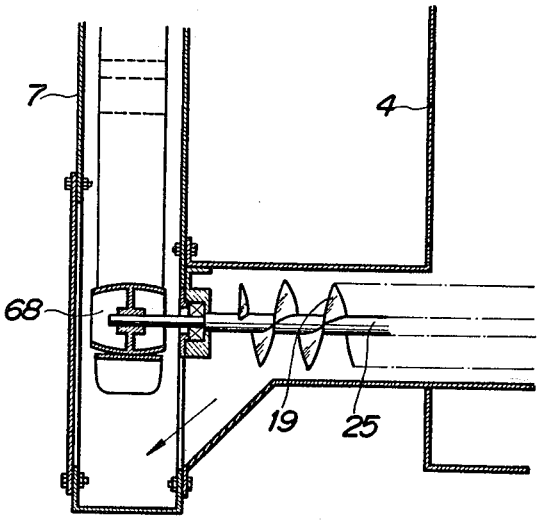
FIG. 10 is a vertical sectional view of the lower port of the basket conveyor illustrated in FIG. 8.

To the upper end of oscillating conveyor 49 there is fitted a take-out opening 40 for hulled rice, to the upper end of oscillating conveyor 48 a take-out opening 39 for a mixture of hulled and unhulled rice, said opening 39 opening above a hopper 59 which is connected to the trough 18, and to the upper end of oscillating conveyor 47 a take-out opening 41 for unhulled rice, said opening being open above the rice supply hopper 10. As illustrated in FIG. 3, a grain circulating conveyor means 7 is provided at a side of support frame box 4 adjacent to the supply side H of separating pan 6 and also adjacent to the hulling chamber 1. To an upper part of circulating conveyor 7 there is provided a shaft 50 to which an operating arm 51 is fitted so that it can rotate thereabout. Said arm 51 is fitted at its forward end to a hopper 52 in which the grain discharged from the conveyor 7 is stored. Numeral 53 indicates a tension spring stretched between the hopper 52 and the circulating conveyor 7. The hopper 52 takes, by the force of spring 53, the position as indicated by the solid lines in FIG. 5, and when it becomes heavy by the grain supplied thereinto, it automatically rotates as indicated by dotted lines in said FIG. 5. Numerals 54, 55 are lugs for the installation of the aforementioned spring 53. A wire cable 56 is fitted at its one end to the end of operating arm 51 and at its another end to the control valve 11 of the grain supply hopper 10. Numeral 57 indicates a control valve fitted to a discharge opening 58 of the supply hopper 52.

In the present invention, as the conveyor 7 has a lower pulley 68 directly fitted to the shaft 25 of screw conveyor 19, an upper pulley is always biased upwardly by a spring 65 placed between a frame 64 and a lug 66, in order to stretch a conveyor belt 69.

The present apparatus having the above constructions operates as follows:

When the motor 28 is driven, the shafts 23, 25, 26, 24 and 60 rotates by the intermediary of belts and pulleys, and consequently the supply roll 42, hulling rolls 8, 8, screw conveyors 19, 21, blower 15 and eccentric 38 are all rotated. It shall be noted in this connection that the transmission of power between the parts is extremely smooth due to the shafts which run in parallel with each other.

When the grain which consists of unhulled rice is supplied manually into the supply hopper 10, the rice passes through a gap formed by the control valve 11, being guided by the rotation of supply roll 42, and is supplied between the pair of hulling rolls 8, 8. Since one of the hulling rolls rotates more rapidly than the other, unhulled rice is twisted therebetween and hulls taken off from the surface of rice fall down. However, it is quite usual that about 10% of the unhulled rice subjected to the hulling operation are not well husked, and they fall down as unhulled. This means that those discharged downwardly from the opening 12 comprises hulled rice, unhulled rice and hulls. Because of the wind blowing longitudinally horizontally within the wind path 2, hulls which are light compared to rice float in the wind, and are sucked by the blower 15 and blown off exteriorly from the exhaust opening 17.

The mixture of unhulled and hulled rice which is comparatively heavy does not move laterally but falls straight downward, enters into the trough 18, moves within the trough transversely to the frame by means of the screw conveyor, then is lifted by the conveyor 7, and then enters into the hopper 52. The mixture of hulled and unhulled rice thus supplied into said hopper is thereafter supplied onto the sorting pan 6 through the discharge opening 58 which is adjusted of its rate of supply by the control valve 57. The shaft 36 which supports the said sorting pan 6 reciprocates in the longitudinal direction of the support frame, when viewed at its plan, by the operation of the eccentric 38 and through the rod 37 connected to the eccentric. Such reciprocation of shaft 36, gives, together with the connecting links 33, 33 lower parts of which are pivatally fitted to the support shank 32 by the shaft 35 and which are slanted as shown in FIG. 2, to the sorting pan 6 the swinging motion which is obliquely directed up and down as represented by the arrows W and which is high above the hulling chamber 1, while low above the winnowing chamber 3, when viewed at its side view.

Therefore, on account of frictional resistance produced between the fluidized friction bed surface 5 and the rice thereupon, the hulled rice having a heavy specific gravity flows along the swing-up side H1 as indicated by the line E1 in FIG. 4 and moves onto the oscillating conveyor 49 through the take-out opening 46, while the unhulled rice having a less heavy specific gravity flows along the swing-down side L1 as represented by the line E3 and moves onto the oscillating conveyor 47 through the take-out opening 44. Between the said two flows of rice, the mixture of hulled and unhulled rice which has not been sorted flows as indicated by the line E2 and moves onto the oscillating conveyor 48 through the take-out opening 45. Because the oscillating conveyors 47, 48 and 49 are serrated at their upper surfaces and also because they are fitted to the sorting pan 6 at its discharge side L and oscillated integrally with said pan, the grain on the conveyors are transferred to the direction of the swing-up side H1. Unhulled rice is fed into the supply hopper 10 through the take-out opening 41, the mixture of hulled and unhulled rice is subjected again to the sorting operation after it passes the take-out opening 39, a funnel 59 and the conveyor 7, and the hulled rice is filled into a desired bag from the take-out opening 40.

If the amount of supply of grain to the apparatus becomes large and consequently the amount of grain on the sorting pan 6 becomes execessive, the sorting operation shall be retarded. In order to prevent this, the hopper 52 is suspended by the supporting arm 51 and spring 53 so that the hopper shall be inclined downwardly when it is charged with a comparatively large amount of grain, and the control valve shall be moved to its closing direction by means of wire cable 56. Hence, the amount of grain to be subjected to the present apparatus can automatically be controlled. It shall be clear from the above description that the separation of hulled rice and unhulled rice can not smoothly made unless the angle of inclination $\alpha$ between the swing-down side L1 and the swing-up side H1 is properly selected. In this invention, in order to achieve this, said angle can be determined properly by rotating the control screw 61 fitted to a part of the supporting shank 32 which is in turn fitted to the sorting pan 6 so that it may move about the rotary shaft 29 like a seesaw.

In general, the size of hulling rolls 8, 8 used in an apparatus of the present kind is about 5 to 10 inches and the diameter of blower is about 1 foot. Therefore, the transverse width $l'$ (FIG. 3) between the side walls 27, 27 of the frame box 4 in which the hulling chamber 1 and the winnowing chamber 3 are accommodated, can be considerably narrower than the longitudinal width $l$ of the frame box. However, the distance $l''$ of the sorting pan cannot be as small as the width $l'$, because the grain is sorted during it flows for said distance. Experiments show that said distance $l''$ has to be at least three times of $l'$, and that the distance $l$ between the swing-up side H1 and the swing-down side L1 requires to be as much as $l''$. Hence, if the sorting pan is oscillated or moved in a direction trasverse to the longitudinal direction of the support box (FIG. 3), the box has to stand against the reaction force of the moving pan with its narrow width $l'$ and the box as a whole has to be made unnecessarily strong.

However, in this invention, the reaction force of moving or oscillation pan in the direction W is caught by the support box 4 with its longer width $l$, whereby the structure of the box can be made moderately strong and hence be compact.

In addition, it shall be noticed, in this invention in which the grain is treated while it is circulated, that the circulation of grain can be made very smoothly because the sorting pan 6 is swung in the direction W in the drawing and because the swing-up side H1 of the sorting pan is located above the hulling chamber 1.

What is claimed is:

1. A grain hulling and sorting apparatus comprising:

a supporting frame box having two longitudinal side walls and two transverse end walls, said longitudinal walls being longer in length than said transverse end walls;

a hulling chamber provided in the upper portion of said frame box, adjacent to one of said transverse walls;

hulling means provided in said hulling chamber for hulling the grain;

winnowing means contained in said frame box, said winnowing means operatively connected to said hulling chamber;

a first hopper located above said hulling chamber for supplying grain thereto;

sorting means containing a single sorting pan moveably fitted above said frame box for sorting hulled and unhulled grain;

a second hopper located above said sorting means for supplying grain thereto;

conveyor means located adjacent to said frame box and operatively connected to said hulling chamber for upwardly transferring said hulled and unhulled grain to said second hopper through a discharge opening at the upper end of said second hopper; and oscillating means connected between said sorting means and said frame box for obliquely oscillating said sorting means parallel to said longitudinal side walls of said frame box.

2. Apparatus according to claim 1 wherein said hulling means, winnowing means, sorting means and conveyor means contain rotatable shafts in parallel with each other and said transverse end walls.

3. Apparatus according to claim 1 wherein the length of said sorting means parallel to said transverse end walls is approximately three times the length of said transverse end walls.

4. Apparatus as claimed in claim 1, wherein said sorting means is movably fitted to said frame box by a shank, said shank supporting said sorting means at a certain angle of inclination relative to said frame box and said angle is adjustable about an axis by a screw fitted to said shank and frame box.

5. Apparatus as claimed in claim 1, wherein said second hopper is connected to the discharge opening of said conveyor means, said second hopper being movable upwardly and downwardly in accordance with the amount of grain stored therein and operatively connected with said first hopper so that the amount of grain to be supplied to the hulling chamber can be controlled according to the amount of grain supplied to and stored in said second hopper.

* * * * *